US008029296B2

(12) United States Patent
Tucci et al.

(10) Patent No.: US 8,029,296 B2
(45) Date of Patent: Oct. 4, 2011

(54) CARBON FIBER ELECTRICAL CONTACTS FORMED OF COMPOSITE CARBON FIBER MATERIAL

(75) Inventors: Michael Tucci, New York, NY (US); Philip Uruburu, Central Islip, NY (US); Stephen Veselaski, Bay Shore, NY (US)

(73) Assignee: Micro Contacts, Inc., Hicksville, NY (US)

( * ) Notice: Subject to any disclaimer, the term of this patent is extended or adjusted under 35 U.S.C. 154(b) by 2647 days.

(21) Appl. No.: 09/899,776

(22) Filed: Jul. 5, 2001

(65) Prior Publication Data

US 2011/0067900 A1 Mar. 24, 2011

(51) Int. Cl.
*C25B 9/00* (2006.01)

(52) U.S. Cl. ..... 439/86; 439/87; 204/279; 200/252; 200/262; 200/275

(58) Field of Classification Search ..... 439/86, 439/87, 884, 886; 204/280, 294, 279, 224 R; 200/275, 252, 262
See application file for complete search history.

(56) References Cited

U.S. PATENT DOCUMENTS

| | | | | |
|---|---|---|---|---|
| 3,619,382 | A | | 11/1971 | Lupinski |
| 3,668,451 | A | | 6/1972 | McNab |
| 3,818,588 | A | | 6/1974 | Bates |
| 3,821,024 | A | | 6/1974 | Wilkin et al. |
| 3,980,914 | A | | 9/1976 | Cunningham |
| 4,358,699 | A | | 11/1982 | Wilsdorf |
| 4,460,633 | A | | 7/1984 | Kobayashi et al. |
| 4,534,366 | A | | 8/1985 | Soukup |
| 4,641,949 | A | | 2/1987 | Wallace et al. |
| 4,694,272 | A | | 9/1987 | Maisch |
| 4,728,755 | A | | 3/1988 | Fowler et al. |
| 4,732,802 | A | | 3/1988 | Bosze et al. |
| 4,762,603 | A | | 8/1988 | Morin |
| 4,855,024 | A | | 8/1989 | Drachnik et al. |
| 4,894,500 | A | | 1/1990 | Yamazaki et al. |
| 4,906,535 | A | * | 3/1990 | Hoge ..... 429/521 |
| 4,912,288 | A | | 3/1990 | Atkinson et al. |
| 4,967,314 | A | | 10/1990 | Higgins, III |
| 4,970,553 | A | | 11/1990 | Orlowski et al. |
| 5,003,693 | A | | 4/1991 | Atkinson et al. |

(Continued)

FOREIGN PATENT DOCUMENTS

DE 3532963 A1 3/1987

(Continued)

OTHER PUBLICATIONS

May 14, 2003 European search report in connection with counterpart European patent application No. 02 39 4117.

(Continued)

*Primary Examiner* — Gary F. Paumen
(74) *Attorney, Agent, or Firm* — Cooper & Dunham LLP

(57) ABSTRACT

A nonmetallic electrical contact or wiper composed of a composite carbon fiber material through which an electrical signal is terminated. The carbon fibers are arranged in and bonded into a multi-layer structure used to conduct a primary electrical signal. A nonwoven carbon fiber mat is used as one or more of the layers structure, which also includes one or layers of carbon fiber, aligned substantially in the same direction, and encapsulated within a matrix of electrometric material. This mat also improves an off-axis conductivity of the material and provides increased mechanical stability required for the fabrication of electrical contacts or wipers produced using this material.

20 Claims, 5 Drawing Sheets

U.S. PATENT DOCUMENTS

| | | | | |
|---|---|---|---|---|
| 5,023,418 | A | 6/1991 | Beckhausen | |
| 5,072,080 | A | 12/1991 | Beckhausen | |
| 5,111,178 | A | 5/1992 | Bosze | |
| 5,117,529 | A | 6/1992 | Ohta | |
| 5,139,862 | A | 8/1992 | Swift et al. | |
| 5,155,306 | A | 10/1992 | Iijima et al. | |
| 5,177,529 | A | 1/1993 | Schroll et al. | |
| 5,270,106 | A | 12/1993 | Orlowski et al. | |
| 5,282,310 | A | 2/1994 | Rommelmann et al. | |
| 5,420,465 | A | 5/1995 | Wallace et al. | |
| 5,780,793 | A | 7/1998 | Buchholz et al. | |
| 6,104,357 | A | 8/2000 | Brage | |
| 6,140,907 | A | 10/2000 | Liu | |
| 6,289,187 | B1 | 9/2001 | Swift et al. | |
| 6,392,529 | B1 | 5/2002 | Liu | |
| 6,444,102 | B1 | 9/2002 | Tucci et al. | |
| 6,565,712 | B2 * | 5/2003 | Lindenfelser | 162/281 |
| 7,267,868 | B2 * | 9/2007 | Gallet et al. | 428/292.1 |
| 7,274,132 | B2 * | 9/2007 | Wierach | 310/340 |
| 7,815,887 | B2 * | 10/2010 | Schafer et al. | 423/447.4 |
| 2003/0008125 | A1 | 1/2003 | Delanoy et al. | |
| 2003/0109189 | A1 * | 6/2003 | Jorder et al. | 442/327 |
| 2006/0078784 | A1 * | 4/2006 | Liu et al. | 429/42 |
| 2006/0091133 | A1 * | 5/2006 | DiPucchio et al. | 219/545 |
| 2007/0054175 | A1 * | 3/2007 | Maendle et al. | 429/40 |
| 2010/0282736 | A1 * | 11/2010 | Koch et al. | 219/553 |

FOREIGN PATENT DOCUMENTS

| | | | |
|---|---|---|---|
| DE | 9215176 | | 2/1992 |
| DE | 9213726 | | 4/1993 |
| DE | 4442617 | A1 | 6/1996 |
| JP | 48-69002 | | 9/1973 |
| JP | 57-210523 | | 12/1982 |
| JP | 61-158681 | | 7/1986 |
| JP | 3-133080 | | 6/1991 |
| JP | 3-211701 | | 9/1991 |
| JP | 5-18001 | | 1/1993 |
| JP | 2000-65594 | | 3/2000 |
| JP | 2000-228848 | | 8/2000 |

OTHER PUBLICATIONS

Sep. 29, 2007 Korean official action with English translation) in connection with counterpart Korean patent application.

May 21, 2007 Korean official action (with English translation) in connection with counterpart Korean patent application.

Aug. 8, 2007 Japanese official action (with English translation) in connection with counterpart Japanese patent application.

Feb. 5, 2008 Japanese official action (with English translation) in connection with counterpart Japanese patent application.

Jul. 28, 2009 Japanese official action (with English translation) in connection with counterpart Japanese patent application.

* cited by examiner 10
12
26
14
16
28
18
20
30
22
24
80
82
84
86
88

CARBON FIBER ELECTRICAL CONTACTS FORMED OF COMPOSITE CARBON FIBER MATERIAL

BACKGROUND OF THE INVENTION

1. Field of the Invention

This invention relates generally to an electrical contact or an electrical contact assembly typically used in an electromechanical device and, more particularly, to a contact or contact assembly, which is formed of a composite material using carbon fibers and a nonwoven carbon fiber mat, as the element that makes electrical contact with another element of the electromechanical device.

2. Description of Background

Variable resistive devices utilize elements that vary a voltage or current in order to provide an electrical signal that indicates a relationship to a physical position of a contact or wiper on a resistive or conductive element. Because these contacts or wipers are used in a dynamic state they can not be fixed or restricted in their movement and must have the freedom to slide or move along any length of their respective resistive or conductive paths. These elements or tracks are custom formulated by each manufacturer and will vary in composition and properties. Because the contact and element have the potential for creating constant friction, the contact or wiper must therefore be produced of a material that is electrically, physically, and environmentally compatible with the resistive and/or conductive track when in the presence of an electrically active and physically dynamic system. The contact or wiper must also provide a long useful life, while maintaining uniform positive engagement with the resistive or conductive element, at a specified applied force, and should not encourage or stimulate the growth of polymers or debris, which act as an insulator and which distort the output signal.

Presently the contact or wiper materials used for these variable resistive devices are composed of various solid precious metals, clad or coated metals, or precious metal alloys. These precious metal containing contacts, in a dynamic state and in the presence of electrical activity, act as catalysts to generate polymers and debris which degrade the resistive track output signals. This results in the early termination of accurate performance and useful life.

Initially metal contacts or wipers were used with wire wound resistive or metallic conductive elements, because wire wound elements were the most precise devices. As time evolved great improvements were made in the non-wire wound product area, and they supplanted the wire wound resistive element, but the contact or wiper has always created problems relative to the resistive element because in the presence of an electrical current and dynamic performance, the precious metal components of the metallic contact provide the catalyst to generate polymers and debris, which interfere with the accuracy of the output signal.

Now that reduction in size, improved accuracy, lower voltages, reduced currents, and a reduction in electrical contact resistance are required in modern servo feedback positioning systems, non-metallic contact materials must be considered to obtain the necessary and sorely needed improvements in these performance characteristics and elimination of the polymers and debris.

Also, the primary metal currently used in the precious metal alloy is Palladium. This metal has seen a 1,800% price increase since its introduction for use in this application. The price increase has been largely due to an uncertain supply of this metal.

Also, new environmental laws are being introduced worldwide mandating that automotive components, which are the largest industry using the device described above, be 100% recyclable. The precious metal currently being used can not be recycled, so that there will be a conflict with this mandate.

Accordingly, the need exists for improvements in electrical contacts and contact assemblies and, particularly, for-improvements in the materials and assemblies employed there for.

OBJECTS AND SUMMARY OF THE INVENTION

Accordingly, it is an object of the present invention to provide a contact or contact assembly for use in electromechanical applications that can effectively eliminate the above-noted defects inherent in previously proposed systems.

It is another object of this invention to eliminate the above-described negative conditions and characteristics of previously known systems and to improve considerably the useful life of the system by providing a contact or wiper formed of nonmetallic material, such as one formed of a composite carbon fiber material including carbon fibers and a nonwoven carbon fiber mat. The composition is formulated to provide similar electrical and mechanical properties as required by the application and lends itself to similar manufacturing techniques. This composite carbon fiber material, through special processing, not only overcomes the negative conditions caused by metal composition contacts or wipers, but considerably improves total performance in all other aspects. The material is designed to facilitate a virtual drop-in replacement contact or wiper.

It is a further object of the present invention to provide a wiper contact or contact assembly for use in electromechanical components or applications that is more compatible with present state of the art fabrication techniques and materials used for resistive and conductive track substrates and that appreciably reduces or eliminates the negative aspects inherent in presently used or previously proposed designs or materials.

In accordance with one aspect of the present invention an existing contact carrier is employed and in place of the previously used metal contacts, the contacts are formed of composite carbon fiber material specially attached to a carrier.

According to one aspect of the present invention, a nonmetallic electrical contact, such as one made of composite carbon fiber material, is processed and formed in such a manner as to allow the multiple strands of carbon fiber at the center layer of the composite material when properly positioned to be electrically conductive for transmitting unimpeded electrical signals along their longitudinal length. Such carbon fiber strands may be fused or conductively bonded by any of various techniques to provide essentially uniform conductivity and redundant transmission of the electrical signal. Additional, off-axis electrical conductivity is provided by nonwoven carbon fiber mats placed on the sides of the multiple strands of carbon fiber. The composite carbon fiber material can be affixed to a carrier or the material may be utilized without a carrier. Such a carrier, if used, may be metallic or non-metallic and may be affixed to the composite carbon fiber material by any of various bonding, fusing, and fastening techniques. The carrier can also be electrically nonconductive, depending upon the application. Alternatively, the carrier can be formed of the same homogenous composite carbon fiber material as that used for the actual contact. Forming of the carbon fiber contact layer of the composite material can involve cross-layering of the material in nonparallel orientations to provide additional structural integrity, as well as to assist in the post-forming operation.

The inventive wiper contact is rigid enough to sustain and maintain a consistent position relative to its parallel alignment to the resistive or conductive track of the substrate element and yet is flexible enough in a perpendicular position to the track to allow some variation in movement to sustain uniform contact position, spring rate and pressure. Thus, the electrical output signal maintains its integrity.

A further aspect of the present invention is that the contact surface of the wiper contact that is adjacent to the resistive or conductive track is composed of multiple points of contact, rather than either a small number of metal fibers or just one broad band of a rigid beam contact. This ensures a more redundant positive footprint with the resistive or conductive track, which reduces contact resistance and variable electrical noise.

Further, the use of carbon and thermoplastics ensures the supply of such a product well into the future. Each of these materials is 100% recyclable and readily available at a substantially reduced cost compared to the currently used precious metal. The resulting unit price will also prove to be less expensive than current products.

The above and other objects, features, and advantages of the present invention will become apparent from the following detailed description of illustrative embodiments thereof to be read in conjunction with the accompanying drawings.

DETAILED DESCRIPTION OF PREFERRED EMBODIMENTS

The present invention provides a contact or wiper element for transmitting electrical signals, either in a low voltage mode (under 45 volts) or a low current mode (under 1000 ma), between a resistive and/or a conductive track and some external circuit termination. In one embodiment-the contact or wiper element comprises one or more thin, single layers of carbon fiber elements, all aligned in one direction bonded together and firmly fixed in a very low-resistance, synthetic resin compound for structural stability and electrical continuity and which form part of a composite carbon fiber material described below.

Although in the following description of several embodiments of the inventive electrical contact various forms of the carbon fiber packages or strands are described, it is to be understood that the electrical contacts are formed of the composite carbon fiber material described below in relation to FIGS. 13 and 14.

Figures 1A, 1B, 1C, 1D, 2A, 2B, 2C, 7:
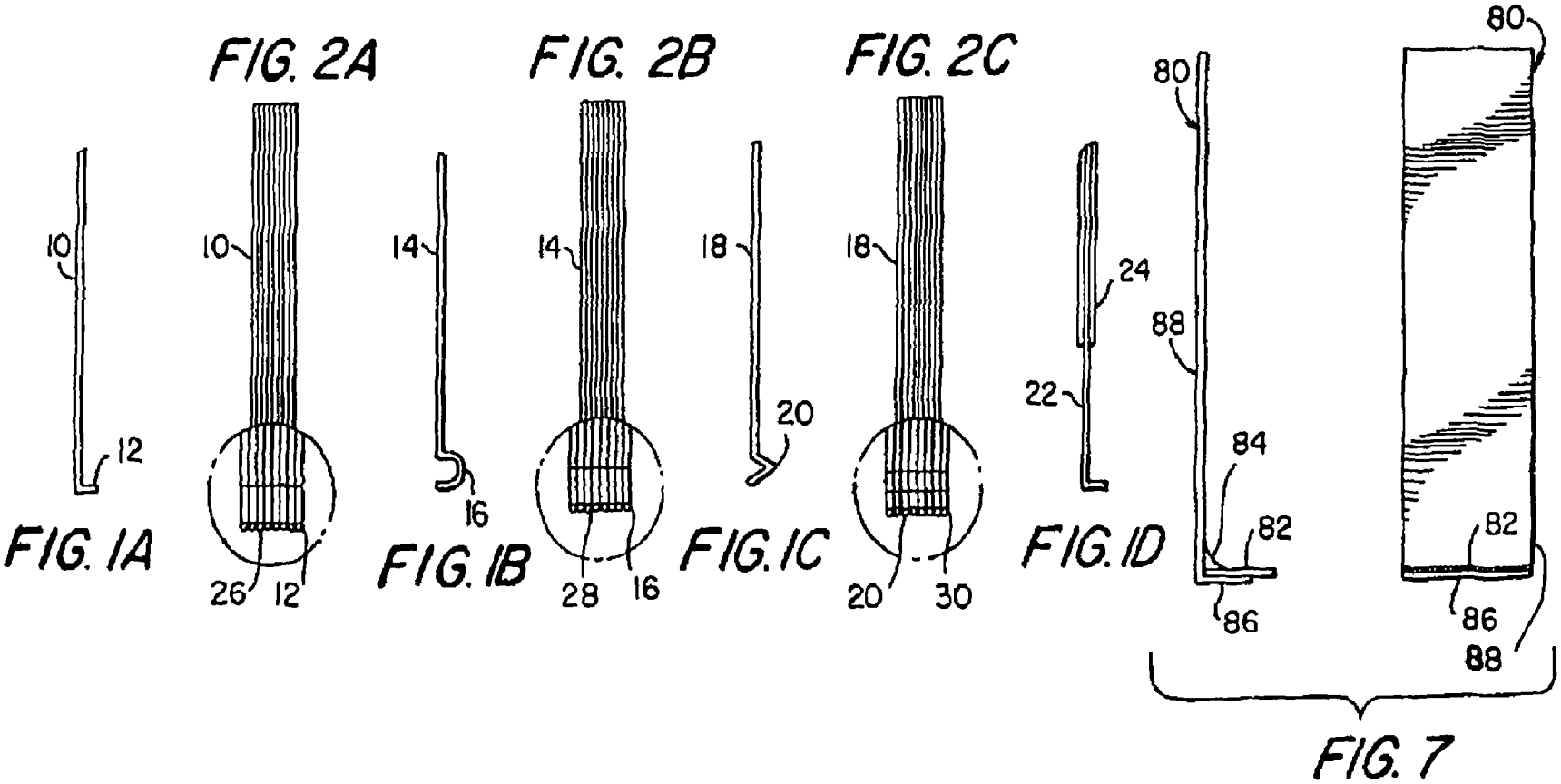
FIGS. 1A-1D are side elevations showing respective embodiments of electrical contacts according to the present invention.
FIGS. 2A-2C are front elevations and respective enlargements showing embodiments of electrical contacts corresponding to FIGS. 1A-1C, respectively.
FIG. 7 shows two views of a carbon fiber electrical contact affixed to an electrically conductive beam according to an embodiment of the present invention.

As shown in FIGS. 1A-1C, the ends of the contact or wiper may be specially formed to give the engagement portion of the contact or wiper added strength and permit better mating of the carbon fiber element to the track of the device. In FIG. 1A, the contact 10 has a rake end 12. In FIG. 1B, the contact 14 has a knuckle end 16. In FIG. 1C, the contact 18 has a pointed end 20.

The contact or wiper 22, as shown in FIG. 1D, may also engage a mechanical strip 24 for support or for attachment purposes. The mechanical strip 24 may be electrically conductive or not, depending upon the desired application.

FIGS. 2A, 2B, and 2C correspond, respectively, to FIGS. 1A, 1B, and 1C and show the arrangement of the carbon fiber packages that are part of the composite material forming the specialized end constructions 12, 16, and 20, respectively. That is, the enlargement of FIG. 2A shows carbon fiber packages 26 arranged in one layer forming the rake end 12. Similarly, packages 28 and 30 respectively form knuckle end 16 and pointed end 20 in FIGS. 2B and 2C, respectively. The other layers of the composite material are not shown because the structures of the carbon fiber packages would be obscured.

Figure 3:
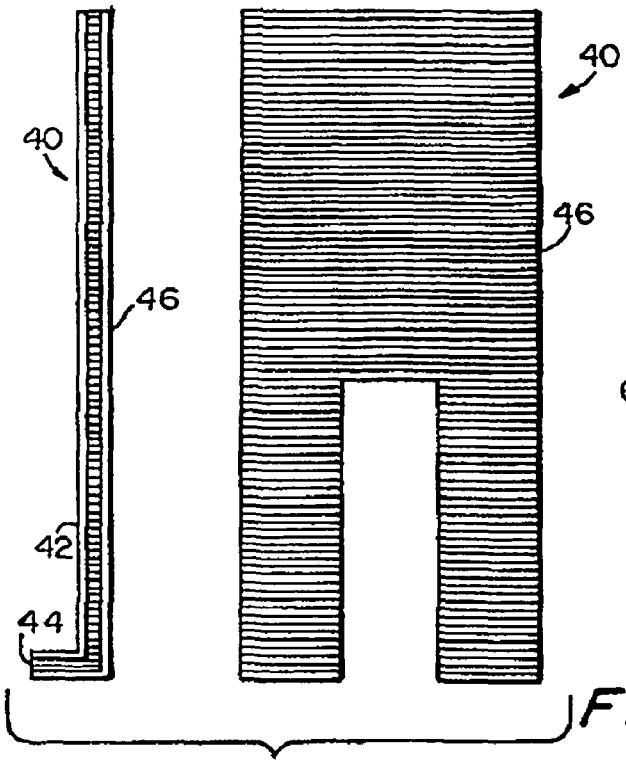
FIG. 3 shows two views of a carbon fiber contact formed as a matrix of layers of carbon fibers.

In the embodiment shown in FIG. 3, the contact or wiper element 40 is formed of a carbon fiber matrix, whose adjacent three carbon fiber layers 42, 44, 46 are essentially perpendicular to each other. The carbon fibers forming layers 42, 44, 46 are not bundled but are discretely placed-in a cross-hatching matrix, wherein the fibers in alternate layers may be parallel to each other, but those in adjacent layers are essentially nonparallel and may be perpendicular to each other.

Figure 4:
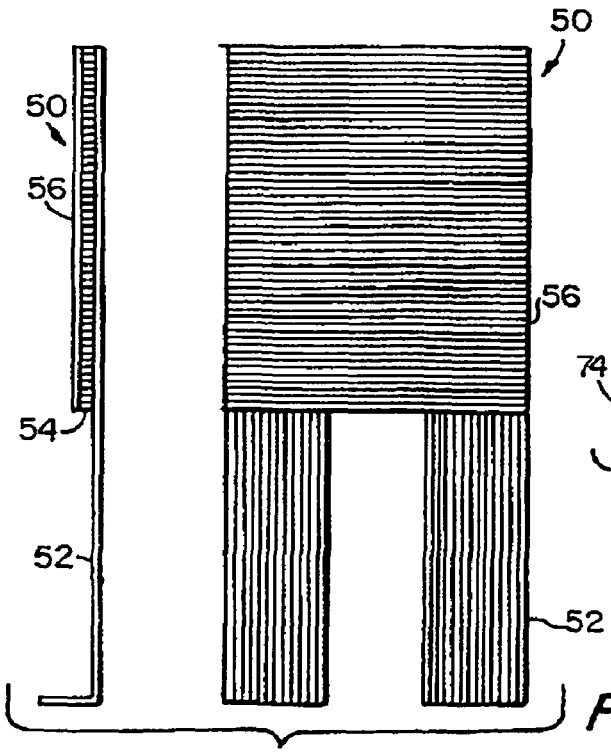
FIG. 4 shows two views of a carbon fiber contact formed as a matrix of layers of carbon fibers.

FIG. 4 shows a similarly constructed contact 50 in which the carbon fibers of only one layer 52 perform the actual contacting and an inner layer 54 and second outer layer provide structural support. The additional layers of the composite material are shown in FIG. 14.

The matrix composition shown in the embodiments of FIGS. 3 and 4 reinforces and strengthens the minuscule carbon fiber strands to provide support for retaining stable contact position. The carbon fiber strands may be continuous or discontinuous and the matrix need not necessarily be homogeneous.

Corresponding to the structure shown in FIG. 1D, the matrix compositions of FIGS. 3 and 4 can use an additional mechanical support strip, which can be electrically conductive depending upon the desired application. The carbon fibers of the matrix composition shown in FIGS. 3 and 4 are firmly fixed in a very low resistance synthetic resin compound to restrict movement, add structural stability, and provide multidirectional electrical continuity.

Figure 5:
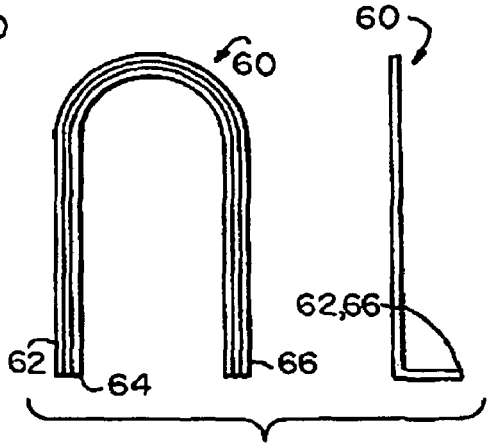
FIG. 5 shows two views of an electrical contact formed solely of carbon fibers according to an embodiment of the present invention.

As shown in FIG. 5, the planar form of a carbon fiber contact element 60 can consist of a single layer, not a matrix of carbon fiber strands, arranged in a horseshoe shape or upside-down U to provide a continuous, unbroken path from one end 62 of the carbon fiber element strands, one of which is shown typically at 64, to the other end 66, even though the carbon fiber strands may change direction by more than 90 degrees. In this embodiment each carbon fiber strand 64 will be both perpendicular and parallel to the resistive or conductive track, not shown, and each opposing end 62, 66 of the continuous carbon fiber strands 64 will essentially contact different parallel resistive or conductive tracks, not shown. The horseshoe-shaped contact 60 can employ a carrier, not shown, which can be electrically conductive or not, depending on the desired application.

Figure 6:
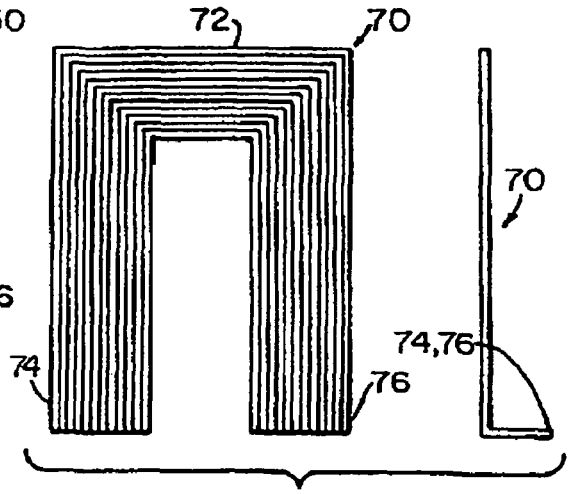
FIG. 6 shows two views of an electrical contact formed solely of carbon fibers according to another embodiment of the present invention.

A similar construction is shown in FIG. 6, wherein the contact 70 has a right-angle transition portion 72 in the path from one end 74 to the other end 76.

In the embodiment shown in FIG. 7, a contact assembly 80 has a carbon fiber element formed as a very short strip 82 firmly and conductively attached at 84 by a conductive adhesive to a parallel portion 84 of a thin beam 86 composed of electrically conductive material. This beam construction provides a means for the current or voltage signal to flow unimpeded from the resistive or conductive track to the end terminus, thereby incorporating the compatible and desirable characteristics of the carbon fiber contact material with beam members formed of materials other than carbon fiber. When this embodiment is in use, the carbon fiber element 82 will be essentially perpendicular to the plane of the resistive or conductive track at all times.

In the embodiment of the present invention shown in FIGS. 2A, 2B, and 2C, the planar form of the carbon fiber element consists of one or more parallel layers of carbon fiber strip arranged so that the free ends 12, 16, 20 of the carbon fiber elements 10, 14, 18, respectively, are designated as the ends that will contact the tracks of the resistive element or conductive element. It is a feature of the present invention that those ends 12, 16, 20 can he fabricated free of any other material, such as the low-resistance, synthetic resin compound or the like, for a length less than 3/16" to permit only the actual carbon fiber material to contact the respective tracks, thereby providing improved mating between the ends 12, 16, 20 of the contacts 10, 14, 18 and the tracks, not shown, of the respective conductive elements. The free end of the contact may remain parallel in the same plane or, as shown in FIGS. 2A, 2B, and 2C, the free end may be bent or formed to an angle perpendicular to the primary length of the strip or formed into a knuckle shape depending upon the application.

Figure 10:
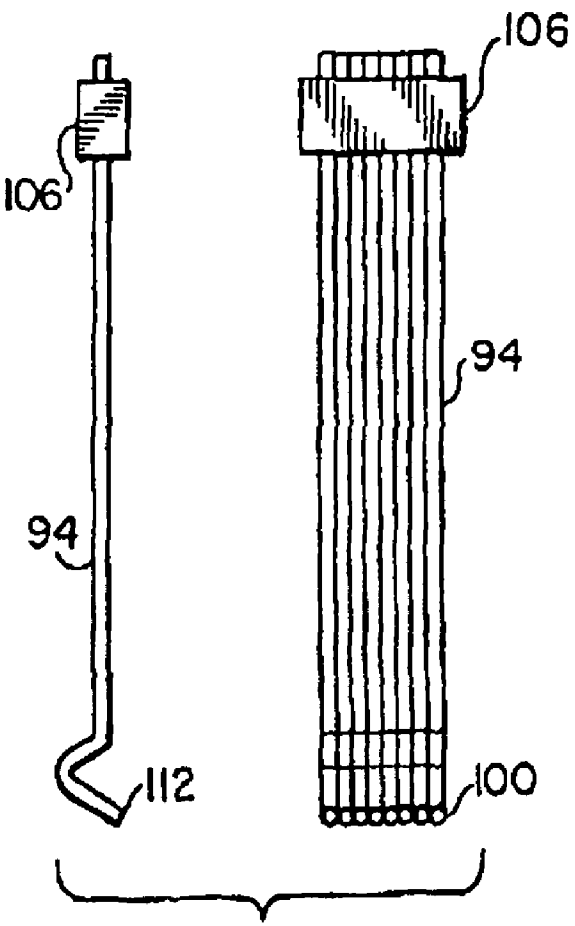
FIG. 10 shows two views of an electrical contact in which the carbon fibers are mechanically captured and chemically fused accordingly to an embodiment of the present invention.
Figure 9:
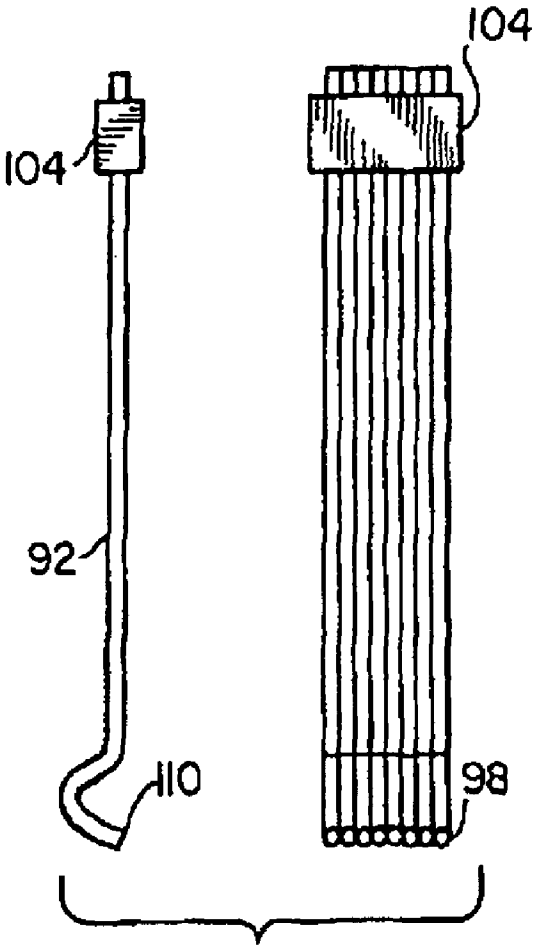
FIG. 9 shows two views of an electrical contact in which the carbon fibers are mechanically captured and chemically fused according to an embodiment of the present invention.
Figure 8:
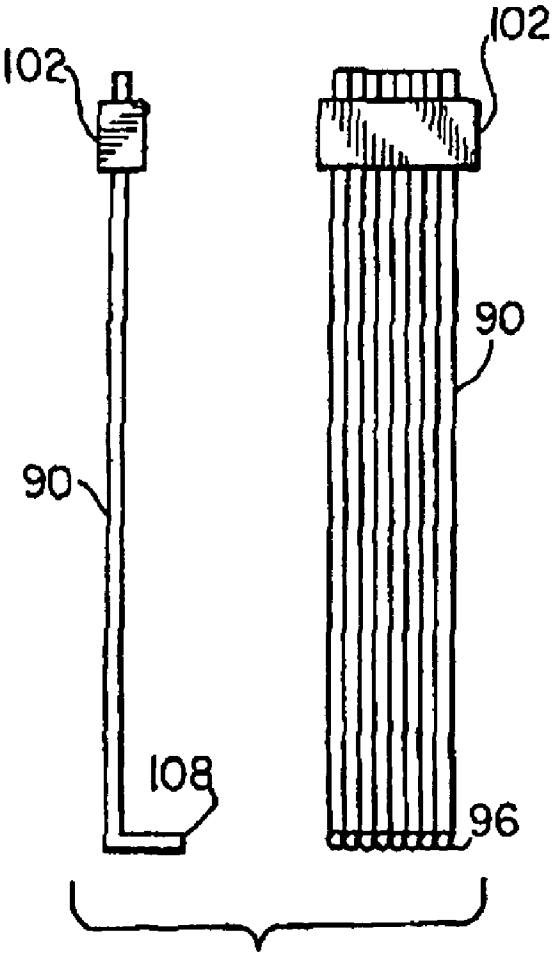
FIG. 8 shows two views of an electrical contact in which the carbon fibers are mechanically captured and chemically fused accordingly to an embodiment of the present invention.

In the embodiments shown in FIGS. 8, 9, and 10, each contact or wiper element 90, 92, 94, respectively, is fabricated in narrow strips of carbon fiber element, one of which is shown at 96, 98, 100, respectively, wherein each strip is less than 0.015 of an inch in width and is composed or one or more parallel strands of carbon fibers. A number of these strips are arranged in a single flat plane, with each strip being essentially parallel to, but not fused or chemically bonded to, each other. The multiple independent parallel strips are mechanically captured by respective collars 102, 104, 106, in a single plane and/or chemically bonded with a low-resistance, electrically conductive synthetic resin compound at one end of the assembled strips, so that the independent multiple strip sections will be electrically uniform in their output signal and also be receptive to further assembly operations.

As shown in FIGS. 8, 9, and 10, the free ends 108, 110, 112 of the respective multiple strip sections 90, 92, 94 that are to function as the intimate contact points with the track of the resistive or conductive element can remain coplanar to the strip or be formed as a rake as shown in FIG. 8, a knuckle as shown in FIG. 9, or other compatible contact geometry, such as the point as shown in FIG. 10. This feature permits the assembly to contain multiple contact strips, such as 96, 98, 100, each with relatively independent mechanical movement in a direction perpendicular to the resistive or conductive track of the substrate element.

Figure 11:
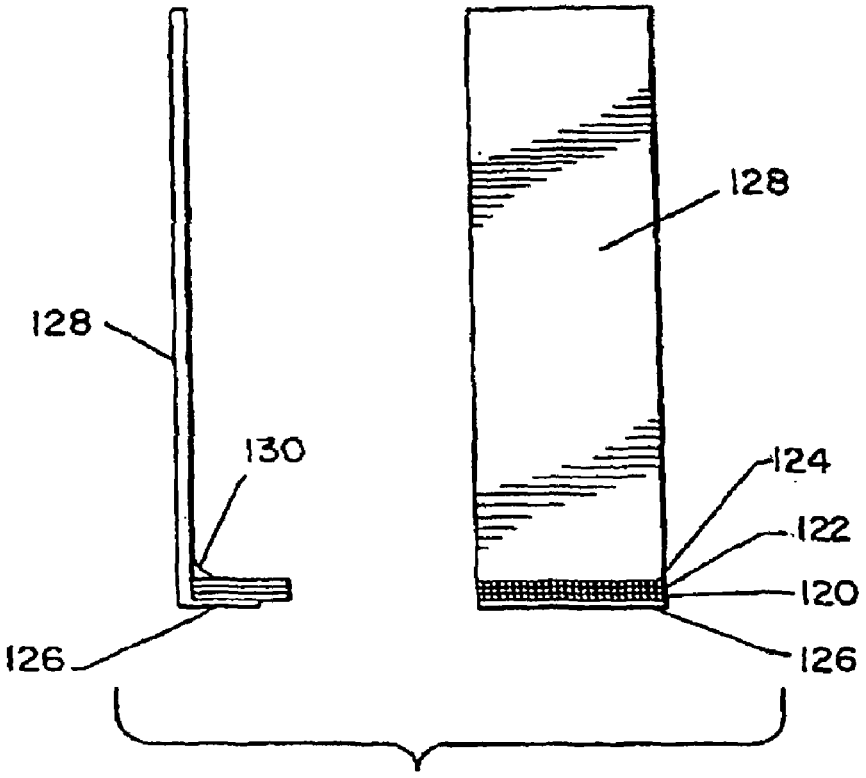
FIG. 11 shows two views of an electrical contact employing multiple layers on a carrier according to an embodiment of the present invention.

FIG. 11 is an embodiment similar to that of FIG. 7 wherein multiple layers 120, 122, 124, of carbon fiber elements are attached to a shorter leg 126 of an L-shaped carrier 128. The carbon fibers in each layer 120, 122, 124 are substantially aligned to be parallel and the layers may be attached to the carrier by an electrically conductive synthetic resin compound shown generally at 130.

As shown in the embodiments of FIGS. 3, 4, and 11, the electrical contact devices are formed of multiple layers of carbon fibers in various alignments. Similarly, all other embodiments herein shown and described can be formed of multiple layers. So too, the various embodiments of the present invention can be used with a carrier that can be electrically conductive or not, depending upon the desired application.

Figure 12:
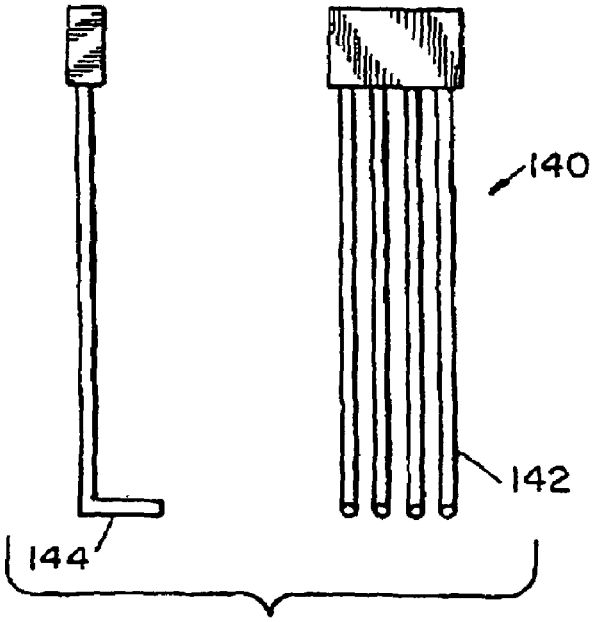
FIG. 12 shows two views of an electrical contact formed as a single carbon fiber element.

Conversely, as shown in FIG. 12, an electrical contact or wiper 140 can be formed of only a single carbon fiber element 142 that can be around 0.010 to 0.015 inches in thickness. Although a rake end 144 is provided in this embodiment, any of the other end treatments described above are also appropriate.

As noted hereinabove, all of the embodiments described so far can be formed from a composite carbon fiber material that has as its core a carbon fiber structure that has carbon fiber collections arranged in one layer, as in FIGS. 2A-22C, or in multiple layers, as in FIG. 3.

Figure 13:
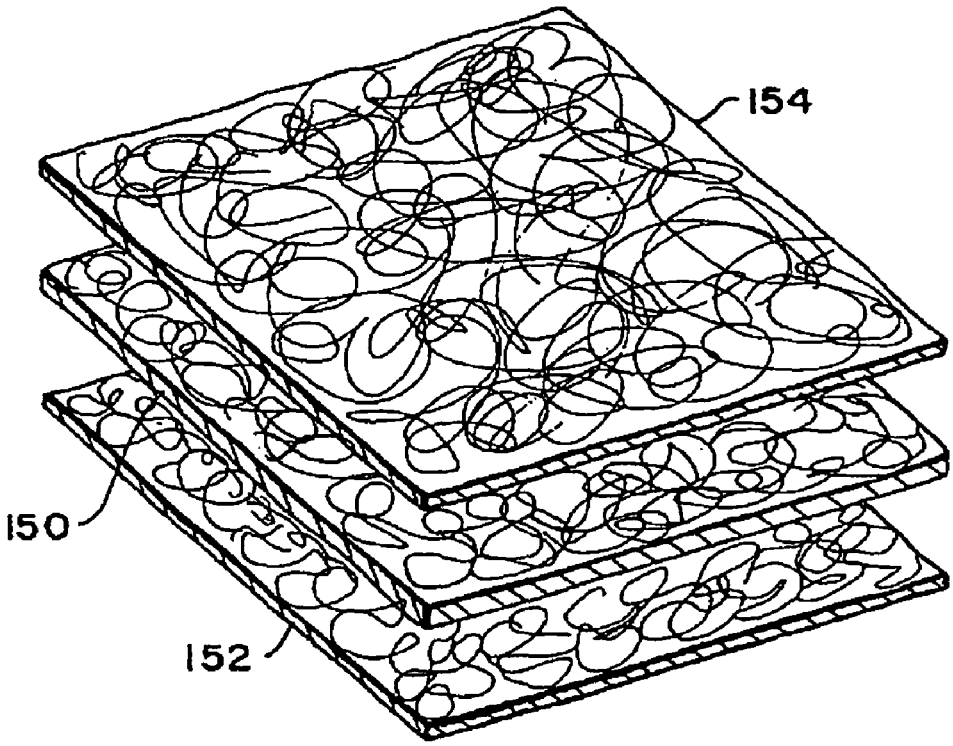
FIG. 13 is an exploded view showing the carbon fibers in juxtaposition with two carbon fiber nonwoven mats.

As shown in FIG. 13, a layer of the carbon fiber collections 150 has mats 152, 154 formed of nonwoven carbon fibers arranged on each flat side. Alternatively, only a single nonwoven carbon fiber mat could be employed. Although not shown in FIG. 13, following the placement of the mats 152, 154 on the carbon fiber collection structure 150, a thermoplastic resin is applied to the exterior surfaces of the mats 152, 154. This thermoplastic resin, or polymer, completes the structure and bonds the mats 152, 154 to the carbon fiber structure 150, thereby forming a stable composite material with all of the carbon fiber material encapsulated in an elastomeric matrix, with only the carbon fiber tips being exposed. The nonwoven carbon-fiber mat 152 or 154 is substantially isotropic and the fibers are so randomly arranged as to provide little or no directionality in the plane of the mat.

The nonwoven carbon fiber mat provides a primary electrical current carrying capacity and also provides improved mechanical strength to the overall construction. More specifically, the nonwoven carbon fiber provides off-axis mechanical stability and increase the spring rate characteristics of the structure, as well as off-axis current carrying capability, where the off-axis term relates to a longitudinal direction of the finally manufactured electrical contact.

The nonwoven carbon fiber mat is available commercially from Hollingsworth & Vose Company, East Walpole, Mass. and ranges in thickness from 0.08 mm to 0.79 mm.

Figure 14:
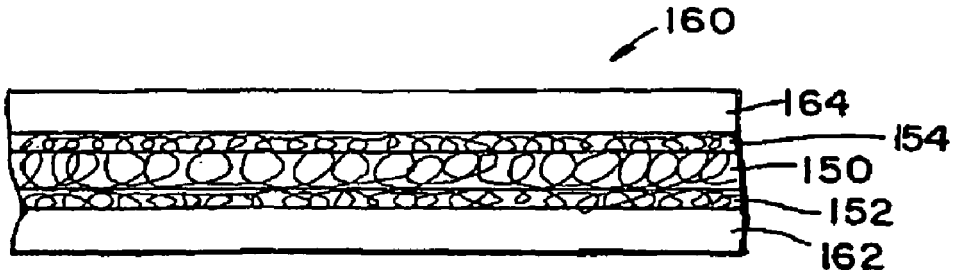
FIG. 14 is an end view showing the several layers making up an embodiment of the inventive composite carbon fiber material.

FIG. 14 is an end view of the assembled composite material 160 described above in which the nonwoven carbon fiber mats 152, 154 are arranged on the carbon fiber structure 150 and in which thermoplastic resin layer 162 is applied over the nonwoven carbon fiber layer 152 and a thermoplastic resin layer 164 is applied over the nonwoven carbon fiber mat 154 so that all of the carbon fiber materials are encapsulated in an elastomeric matrix, with only the working ends of the carbon fibers being exposed. This results in a stable composite material that can be formed to any desired shape, as described and shown in regard to the several embodiments shown herein.

It is understood, of course, that the foregoing description is presented by way of example only and is not intended to limit the spirit or scope of the present invention, which is to be defined by the appended claims.

What is claimed is:

1. An electrical device for transmitting electrical signals and for movable contact with an electrically conductive track, the device comprising, an electrical contact composed of a multi-layer structure of a composite carbon fiber material having at least one layer of carbon fibers aligned in substantially the same direction and at least one layer of nonwoven carbon fiber mat, said layer of carbon fibers and said at least one layer of nonwoven carbon fiber mat being encapsulated in an elastomeric matrix, whereby free ends of said layer of carbon fiber elements are arranged to contact the electrically conductive track.

2. The electrical device according to claim 1, further comprising a support strip having said electrical contact bonded thereto by a synthetic resin compound.

3. The electrical device according to claim 2, wherein said support strip is electrically conductive.

4. The electrical device according to claim 2, wherein said support strip is bent so as to be L-shaped and said electrical contact is attached to a shorter arm of said L-shaped strip.

5. The electrical device according to claim 1, wherein the free ends of said layer of carbon fiber elements are formed in a knuckle shape.

6. The electrical device according to claim 1, wherein the free ends of said layer of carbon fiber elements are formed in an angularly pointed shape.

7. The electrical device according to claim 1, further comprising support elements arranged on external sides of said elastomeric matrix at an end opposite said free ends and being set back from said free ends.

8. An electrical device for transmitting electrical signals and for moveable contact with an electrically conductive track, the device comprising;

an electrical contact composed of a multi-layer structure having at least one layer of carbon fibers aligned in substantially the same direction and at least one layer of nonwoven carbon fiber mat, said one layer of carbon fibers and said layer of nonwoven carbon fiber mat being encapsulated in an elastomeric matrix; and fastening means arranged at one end of said electrical contact for holding together said layer of carbon fiber elements and preventing relative movement there among at a holding location, whereby free ends of said electrical contact opposite said one end are moveable relative to one another.

9. The electrical device according to claim 8, wherein the free ends of said layer of carbon fiber elements are formed in a knuckle shape.

10. The electrical device accordingly to claim 8, wherein the free ends of said layer of carbon fiber elements are found in an angularly pointed shape.

11. An electrical device for transmitting electrical signals and for movable contact with electrically conductive tracks, the device comprising;

an electrical contact formed of a composite carbon fiber material having at least one layer of carbon fiber elements bonded together and being sandwiched between first and second mats of nonwoven carbon fibers with a thermoplastic resin coating on outer surfaces of said first and second mats, said electrical contact having a first arm portion, wherein the carbon fiber elements are aligned substantially in a first direction, a second arm portion spaced apart from and in a same plane as said first arm portion, wherein the carbon fiber elements therein are aligned substantially in the first direction, and a transition portion connecting respective first ends of said first arm portion and said second arm portion, wherein the carbon fiber elements of said transition portion are substantially aligned with each other in a second direction different from said first direction of said first and second arm portions, wherein second ends of said first and second arm portions opposite said first ends are adapted to contact said electrically conductive tracks.

12. The electrical device accordingly to claim 11, wherein said transition portion is arranged at right angles to said first and second arm portions, so that said second direction is substantially perpendicular to said first direction.

13. The electrical device according to claim 11, wherein said transition portion is semicircular in shape and is coplanar with said first and second arm portions.

14. An electrical device for transmitting electrical signals and for moveable contact with electrically conductive tracks, the device comprising:

an electrical contact composed of a multi-layer structure having at least one layer of carbon fibers aligned in substantially the same direction and at least one nonwoven carbon fiber mat, said layer of carbon fibers and said nonwoven carbon fiber mat being encapsulated in an elastomeric matrix.

15. The electrical device according to claim 14, wherein said electrical contact is formed having a body portion and first and second arm portions extending therefrom, wherein free ends of said first and second arm portions are adapted to contact the electrically conductive tracks.

16. The electrical device according to claim 15, wherein said free ends are formed in a rake shape.

17. The electrical device according to claim 15, wherein said layer of carbon fibers and said nonwoven carbon fiber mat are coextensive.

18. The electrical device according to claim 15, wherein said first and second arm portions are formed of a single layer of carbon fibers.

19. An electrical device for transmitting electrical signals and for movable contact with an electrically conductive track, the device comprising:

an electrically conductive carrier;

a contact formed of a composite carbon fiber material having a plurality of layers of carbon fiber elements arranged in overlaying relationship and affixed on said carrier and being sandwiched between first and second mats formed of nonwoven carbon fibers with a thermoplastic resin coating on outer surfaces of said first and second mats, wherein the carbon fiber elements in each layer are aligned in substantially the same direction and free ends of the carbon fiber elements are adapted to contact said electrically conductive track.

20. The electrical device according to claim 19, wherein said carrier is substantially L-shaped and said plurality of layers of carbon fiber elements are affixed to a shorter leg of said L-shaped carrier.

* * * * *

UNITED STATES PATENT AND TRADEMARK OFFICE

CERTIFICATE OF CORRECTION

PATENT NO. : 8,029,296 B2
APPLICATION NO. : 09/899776
DATED : October 4, 2011
INVENTOR(S) : Michael Tucci, Philip Uruburu and Stephen Veselaski It is certified that error appears in the above-identified patent and that said Letters Patent is hereby corrected as shown below:

Title Page, item (63);
Insert the following Domestic Priority Application Data
on the cover page of the patent:

--This application is a continuation-in-part of U.S. Application No. 09/498,872, filed February 7, 2000, now U.S. Patent No. 6,444,102--

Signed and Sealed this
Twenty-second Day of November, 2011

David J. Kappos

David J. Kappos
*Director of the United States Patent and Trademark Office*